US010117531B1

(12) United States Patent
Hoban

(10) Patent No.: US 10,117,531 B1
(45) Date of Patent: Nov. 6, 2018

(54) ADJUSTABLE FRAMING

(71) Applicant: Katherine Hoban, Denver, CO (US)

(72) Inventor: Katherine Hoban, Denver, CO (US)

( * ) Notice: Subject to any disclaimer, the term of this patent is extended or adjusted under 35 U.S.C. 154(b) by 0 days.

(21) Appl. No.: 15/988,330

(22) Filed: May 24, 2018

(51) Int. Cl.
*A47B 1/10* (2006.01)
*A47G 1/10* (2006.01)
*G09F 15/00* (2006.01)

(52) U.S. Cl.
CPC ..... *A47G 1/10* (2013.01); *G09F 15/0012* (2013.01); *G09F 15/0018* (2013.01)

(58) Field of Classification Search
CPC .... A47G 1/10; G09F 15/0018; G09F 15/0012
See application file for complete search history.

(56) References Cited

U.S. PATENT DOCUMENTS 3,541,714 A * 11/1970 Bruck, Jr. ..... A47G 1/0638 40/759
3,736,684 A 6/1973 Grad
4,446,641 A * 5/1984 Cosaert ..... A47G 1/0605 40/784
4,477,990 A 10/1984 Buchanan
4,509,278 A * 4/1985 Astolfi ..... A47G 1/0638 248/490
D388,317 S * 12/1997 Brandes ..... D8/403
8,397,412 B2 * 3/2013 Rosenbaum ..... G09F 1/10 273/157 R
8,898,945 B2 * 12/2014 Miller ..... A47G 1/162 40/713

* cited by examiner

*Primary Examiner* — Cassandra Davis
(74) *Attorney, Agent, or Firm* — MP Patents, LLC

(57) ABSTRACT

A framing system includes a first screen, a second screen and a first bracket. The first bracket includes an internal slot configured to receive a portion of the inner and outer surfaces of the first screen as well as a portion of the inner and outer surfaces of the second screen. A first gripping member is configured to selectively extend into the internal slot of the first bracket to secure the first screen and the second screen. A method for framing includes securing graphics to a first screen, placing a second screen against the graphics such that the graphics is between the first and second screens, inserting the assembled graphics and first and second screens into an internal slot of at least one bracket and, with a gripping member, pressing the first screen against the second screen and the second screen against an internal surface of the internal slot.

15 Claims, 2 Drawing Sheets

ADJUSTABLE FRAMING

SUMMARY

The disclosure seeks to provide a graphics display system. The graphics display system includes a first screen with inner and outer surfaces and a plurality of edges between the inner and outer surfaces, a second screen with inner and outer surfaces and a plurality of edges between the inner and outer surfaces and first and second brackets. The first bracket includes a front wall, a rear wall parallel with the front wall, a first sidewall orthogonal to the front wall, a second sidewall orthogonal to the front wall and to the first sidewall, a third sidewall orthogonal to the front wall and forming an acute angle with each of the first and second sidewalls. An internal slot extends into the third sidewall towards the first and second sidewalls, the internal slot encompassing at least a first edge of the plurality of edges of the first screen and at least a first edge of the plurality of edges of the second screen such that at least a first edge of the plurality of the edges of the first screen is aligned with at least a first edge of the plurality of edges of the second screen and the inner surface of the first screen is constrained relative to the inner surface of the second screen. A bore extends into the internal slot through the rear wall or through the front wall. The second bracket includes a front wall, a rear wall parallel with the front wall, a first sidewall orthogonal to the front wall, a second sidewall orthogonal to the front wall and to the first sidewall and a third sidewall orthogonal to the front wall and forming an acute angle with each of the first and second sidewalls. An internal slot extends into the third sidewall of the second bracket towards the first and second sidewalls, the internal slot encompassing at least a second edge of the plurality of edges of the first screen and at least a second edge of the plurality of edges of the second screen such that one or more other edges of the first screen is aligned with one or more other edges of the second screen. A bore extends into the internal slot of the second bracket through the rear wall or through the front wall. A first gripping member extends from the bore of the first bracket into the internal slot of the first bracket and compresses the first and second screens and a second gripping member extends from the bore of the second bracket into the internal slot of the first bracket and compresses the first and second screens.

The disclosure also seeks to provide a framing system including a first screen having inner and outer surfaces and a plurality of edges between the inner and outer surfaces, a second screen having inner and outer surfaces and a plurality of edges between the inner and outer surfaces and a first bracket. The first bracket includes a front wall, a rear wall parallel with the front wall, a first sidewall orthogonal to the front wall, a second sidewall orthogonal to the front wall and to the first sidewall, a third sidewall orthogonal to the front wall and forming an acute angle with each of the first and second sidewalls and an internal slot extending into the third sidewall towards the first and second sidewalls and configured to receive a portion of the inner and outer surfaces of the first screen as well as a portion of the inner and outer surfaces of the second screen. A first gripping member is configured to selectively extend into the internal slot of the first bracket to secure the portion of the inner and outer surfaces of the first screen as well as the portion of the inner and outer surfaces of the second screen.

Still further, the disclosure seeks to provide a method for framing graphics. The method includes securing the graphics to a first screen having inner and outer surfaces, placing a second screen having inner and outer surfaces against the graphics such that the graphics is between the first screen and the second screen, inserting the assembled graphics, first screen and second screen into an internal slot of at least one bracket and pressing the first screen against the second screen and the second screen against an internal surface of the internal slot with a gripping member.

BRIEF DESCRIPTION OF THE FIGURES

The summary above, as well as the following detailed description of illustrative embodiments, is better understood when read in conjunction with the appended drawings. For the purpose of illustrating the disclosure, example constructions of the disclosure are shown in the drawings. However, the disclosure is not limited to specific methods and instrumentalities described herein. Moreover, those in the art will understand that the drawings are not to scale. Wherever possible, like elements have been indicated by identical numbers.

Embodiments of the disclosure will now be described, by way of example only, with reference to the following diagrams wherein.

DETAILED DESCRIPTION

The following detailed description illustrates embodiments of the disclosure and manners by which they can be implemented. Although the best mode of carrying out the disclosure has been described, those skilled in the art would recognize that other embodiments for carrying out or practicing the disclosed systems and methods are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

Known framing techniques either require a user purchase a standard-sized, fully assembled frame which may not fit the dimensions of the object to be framed or require custom construction by a framing professional.

Disclosed systems and methods allow a user to quickly and easily frame a picture, a photograph, art or other graphics object in a floating style without the assistance of a framing professional.

Because brackets of the disclosed systems may be relatively variably spaced in accordance with the floating style in which the frame is discontinuous and does not form a closed shape, graphics objects of a variety of dimensions may be framed. Additional aspects, advantages, features and objects of the disclosure will be made apparent from the drawings and the detailed description of the illustrative embodiments construed in conjunction with the appended claims that follow.

It will be appreciated that features of the disclosure are susceptible to being combined in various combinations without departing from the scope of the disclosure as defined by the appended claims.

Figure 1B:
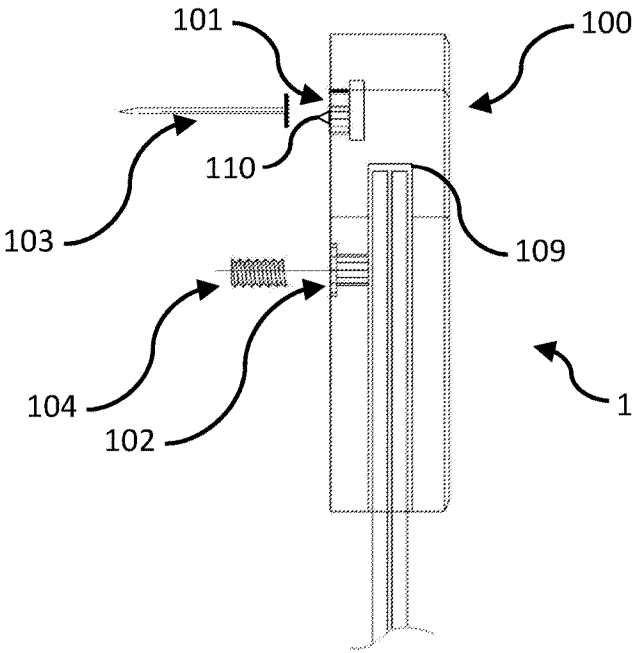
FIG. 1B illustrates a right, side view of an example bracket configured for use in disclosed systems and methods.
Figure 1A:
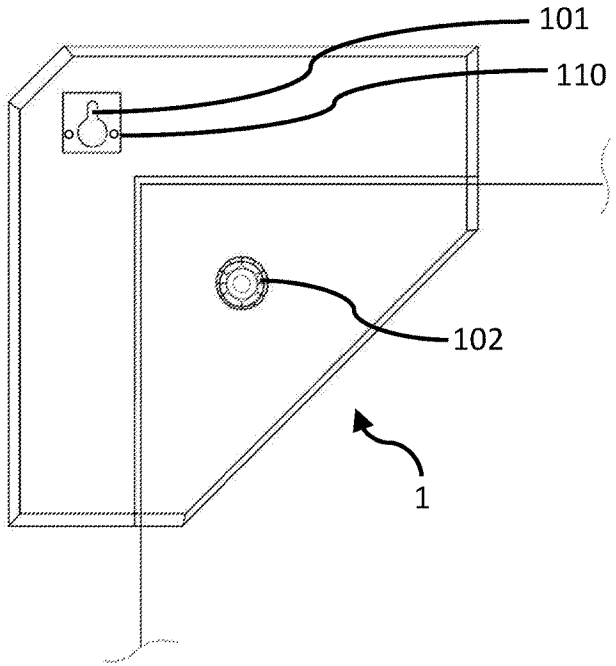
FIG. 1A illustrates a rear view of an example bracket configured for use in disclosed systems and methods.
Figure 1C:
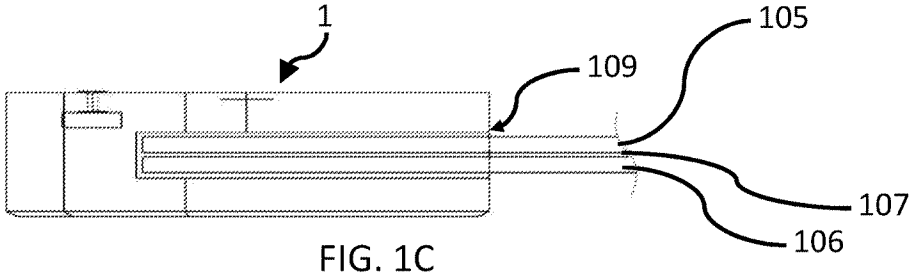
FIG. 1C illustrates a top view of an example bracket configured for use in disclosed systems and methods.

The disclosure seeks to provide a framing system illustrated by way of example in FIGS. 1A-1C. Framing system 1 includes a first screen 105 having inner and outer surfaces and a plurality of edges between the inner and outer surfaces and a second screen 106 having inner and outer surfaces and a plurality of edges between the inner and outer surfaces. One or more brackets are also included.

First screen 105, second screen 106 or both are configured to enable viewing of one or more objects therethrough. For example, first screen 105, second screen 106 or both are substantially translucent. In a further example, first screen 105, second screen 106 or both are substantially transparent. The first and second screens 105 and 106 may be formed of any of a variety of materials enabling at least partial viewing of graphics placed therebetween. Such materials include but are not limited to glass and clear acrylic.

First and second screens 105 and 106 may be provided in any of a variety of thicknesses suitable for receipt within internal slots of the brackets. In an example, the first and second screens 105 and 106 are provided in a thickness of about 3 mm. In another example, one of the first and second screens 105 and 106 may be provided with a thickness of about 3 mm while the other of the first and second screens 105 and 106 may be provided with a thickness of about 6 mm.

Edges of first and second screens 105 and 106 may be provided in any of a variety of lengths such that first and second screens 105 and 106 may be configured as any of a variety of shapes. In an example, first and second screens 105 and 106 may be configured as rectangular. When configured as rectangular, first and second screens 105 and 106 may be provided with any of a variety of heights and/or any of a variety of widths.

In an example, mounting tabs (not shown) may be provided for aligning to the back of the graphics object and mounting the same to at least one of the screens. Mounting tabs may include an adhesive on one or both sides for securing the graphics object to a screen.

Framing system 1 further includes at least one bracket or corner piece. Bracket 100 has a front wall, a rear wall parallel with the front wall and a first sidewall orthogonal to the front wall. A second sidewall is orthogonal to the front wall and to the first sidewall. A third sidewall is orthogonal to the front wall and forms an acute angle with each of the first and second sidewalls. An internal slot 109 extends into the third sidewall towards the first and second sidewalls and is configured to receive a portion of the inner and outer surfaces of first screen 105 as well as a portion of the inner and outer surfaces of second screen 106. Internal slot 109 is configured to align one or more edges of the first screen with one or more edges of the second screen. In an example, the portions of the inner and outer surfaces received by the internal slot include corners of first and second screens 105 and 106. Internal slot 109 may take a triangular shape in plan.

Bracket 100 may be generally rectangular in shape but have a first truncated corner forming the third sidewall and a second truncated corner opposite the third sidewall. Internal slot 109 may be similar in shape to bracket 100 overall for example having interior surfaces parallel with each of the front wall, rear wall, first sidewall and second sidewall. Other examples of bracket 100 may be generally rectangular in shape and lack the first and second truncated surfaces. Still further examples of bracket 100 may take any of a variety of shapes such as triangular or hexagonal. Bracket 100 may be constructed from any of a variety of durable, lightweight materials including but not limited to wood, plastic or resin.

Framing system 1 further includes a first gripping member 104 configured to selectively extend into internal slot 109 of bracket 100 to secure the portion of the inner and outer surfaces of first screen 105 as well as the portion of inner and outer surfaces of second screen 106. In an example, gripping member 104 is a threaded fastener and the inner and outer surfaces of first screen 105 and the portion of inner and outer surfaces of second screen 106 are secured with the gripping member by rotation of the fastener in a first direction within a bore of the at least one bracket. Rotation of gripping member 104, may additionally compress one or both of screens 105 and 106 into an internal surface of internal slot 109 closest to the front surface of a bracket 100. In a further example, gripping member 104 is a socket screw or a grub allen cone screw.

Framing system 1 may be further provided with a tool (not shown) for driving gripping member 104. For example, an allen wrench may be provided for engaging a head of a fastener implemented as gripping member 104.

A keyhole opening 101 extends into the rear wall of bracket 100 and is configured to receive a head of a fastener such as fastener 103 and a portion of a shaft of the fastener such that while the head of the fastener is aligned with a constricted, elongate portion of keyhole opening 101, it is prevented from being drawn directly away from bracket 100. In order to engage a fastener with keyhole opening 101, the head is inserted into an enlarged portion of keyhole opening 101 and then moved along keyhole opening 101 into the constricted portion thereof. Disengagement of a fastener from bracket 100 requires reversing this action by sliding the head along the keyhole opening away from the constricted portion to the enlarged portion and then withdrawing the head through the enlarged portion or pulling bracket 100 away from the fastener head. Referring to FIGS. 1A & 1B, sliding of the fastener head during an engagement/disengagement action occurs in a substantially vertical orientation.

Framing system 1 further includes at least one protuberance 110 adjacent to keyhole opening 101 of bracket 100. In an example, bracket 100 may include two protuberances with one positioned on each of opposite sides of keyhole opening 101. Protuberances 110, when pressed against a surface by which the graphics display system is to be supported, mark the surface. For example, each protuberance 110 may be configured as a cone or pyramid or so as to have a triangular profile (FIG. 1B). Marking the surface with protuberances 110 facilitates identifying a location to form a hole for a hanging fastener. For example, a user may desire to form a hole on, adjacent to or between markings provided by protuberances 110.

In an example of framing system 1, one or more brackets 100 are provided and first and second screens 105 and 106 are separately provided. In another example, four or more brackets 100 are provided together and first and second screens 105 and 106 are separately provided.

Figure 2B:
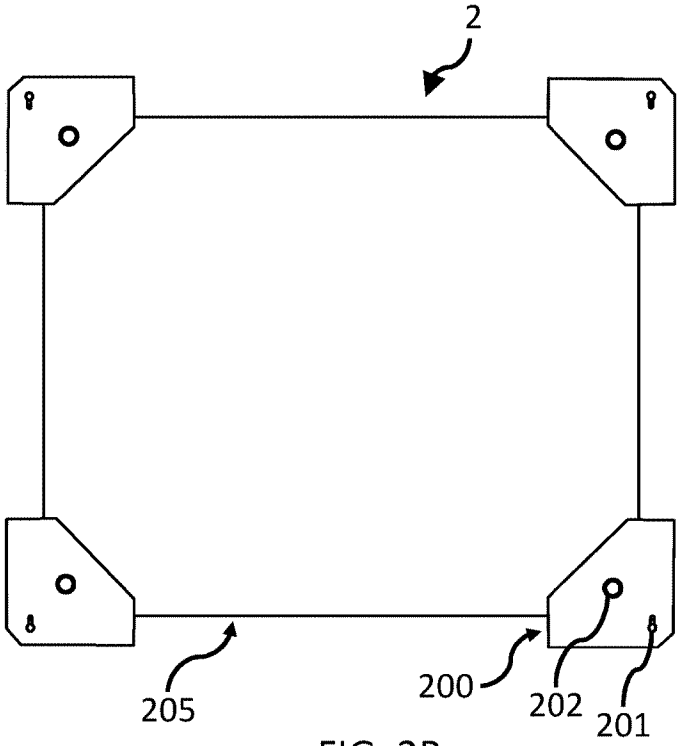
FIG. 2B illustrates a rear view of an example system according to the disclosure.
Figure 2A:
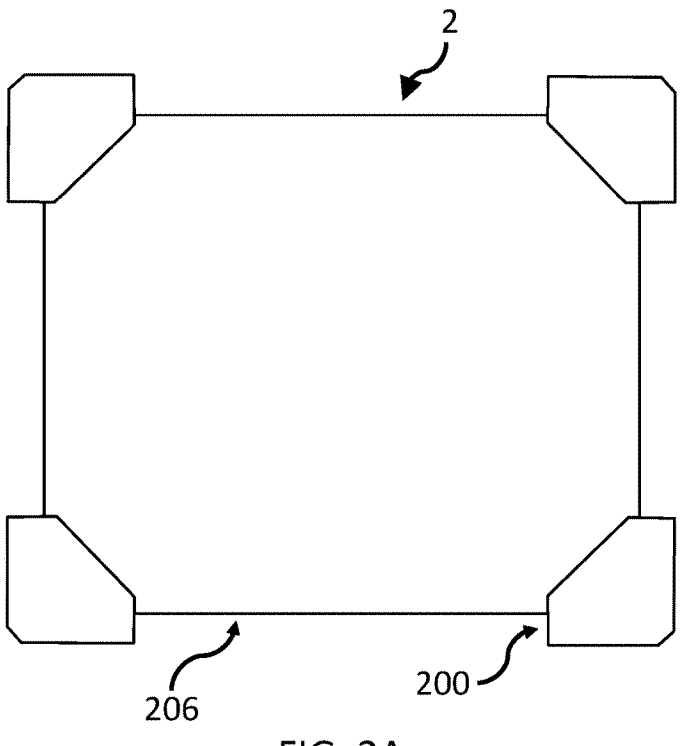
FIG. 2A illustrates a front view of an example system according to the disclosure.
Figure 2C:
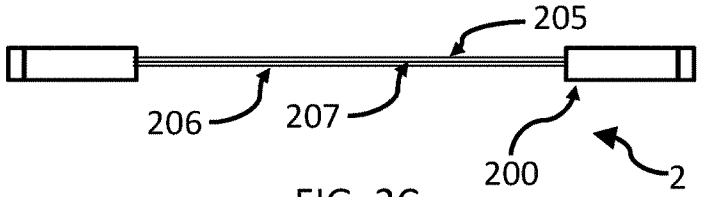
FIG. 2C illustrates a top view of an example system according to the disclosure.

In yet another example, four or more brackets are provided together with first and second screens as a graphics display system illustrated by way of example in FIGS. 2A-2C.

Graphics display system 2 includes a first screen 205 with inner and outer surfaces and a plurality of edges between the inner and outer surfaces and a second screen 206 with inner and outer surfaces and a plurality of edges between the inner and outer surfaces.

First screen 205, second screen 206 or both are configured to enable viewing of one or more objects therethrough. For example, first screen 205, second screen 206 enable viewing of graphics placed therebetween including but not limited to art, photographs or text provided as hard copies or digitally. Further, what a user places between screens 205 and 206 is only limited by the thickness of internal slot provided to brackets 200. First and second screens 205 and 206 may be provided in any of a variety of thicknesses suitable for receipt within internal slots of brackets 200 with a graphical object held therebetween. Edges of first and second screens 205 and 206 may be provided in any of a variety of lengths such that first and second screens 205 and 206 may be configured as any of a variety of shapes Graphics display system 2 further includes a plurality of brackets 200. As with bracket 100 described with reference to FIGS. 1A-1C, each bracket 200 has a front wall, a rear wall parallel with the front wall, a first sidewall orthogonal to the front wall, a second sidewall orthogonal to the front wall and to the first sidewall, and a third sidewall orthogonal to the front wall and forming an acute angle with each of the first and second sidewalls. An internal slot extends into the third sidewall towards the first and second sidewalls and encompasses a portion of at least one of the plurality of edges of first screen 205 and a portion of at least one of the plurality of edges of second screen 206 such that one or more edges of first screen 205 are aligned with one or more edges of second screen 206 and the inner surface of first screen 205 is constrained relative to the inner surface of second screen 206. A bore 202 extends into the internal slot through the rear wall or through the front wall.

The graphics display system further includes a first gripping member 204 extending from bore 202 of each bracket 200 into internal slot 209, compressing first and second screens 205 and 206 together and coupling first and second screens 205 and 206 to each bracket 200.

A keyhole opening 201 extends into the rear wall of each bracket 200 and is configured to receive a head of a fastener and a portion of a shaft of the fastener such that while the head of the fastener is aligned with an elongate portion of the keyhole opening, it is prevented from being drawn directly away from the bracket.

In an example, some of brackets 200 may be provided with less than all of disclosed features such as keyhole opening 201 and internal slot 209. In another example, each of brackets 200 include the same features but in different orientations such that one of brackets 200 may be symmetric to a second of brackets 200 about a first axis and symmetric to a third of brackets 200 about a second axis. For example, rotating bracket 200 of the lower right of FIG. 2B 90 degrees clockwise does not yield bracket 200 of the lower left of FIG. 2B because the respective keyhole openings 201 will exhibit 90 degrees of relative rotation. Similarly, rotating bracket 200 of the lower right of FIG. 2B 90 degrees counterclockwise does not yield bracket 200 of the upper right of FIG. 2B because the respective keyhole openings 201 will again exhibit 90 degrees of relative rotation.

Modifications to disclosed examples are possible without departing from the scope of the disclosure as defined by the accompanying claims and features described with respect to a particular example or embodiment may be substituted for features described with respect to another example or embodiment or one or more features may be excluded from any particular example or embodiment.

Still further, the disclosure seeks to provide a method for displaying graphics such as graphics object 107 (FIGS. 1A-1C). With a substantially two-dimensional graphics object provided, the graphics object is secured to an inner surface of one at least two screens. In an example, securing the graphics object includes aligning adhesive mounting tabs to the back of the graphics object and mounting the graphics object to the screen. The inner surface of the other of the at least two screens is then placed against the graphics object such that the graphics object is held between the screens.

The assembled graphics, the first screen and the second screen are inserted into an internal slot of each of at least two brackets. For example, mutually aligned first corners of the first and second screens are inserted into the internal slot of a first bracket, mutually aligned second corners of the first and second screens are inserted into the internal slot of a second bracket, mutually aligned third corners of the first and second screens are inserted into the internal slot of a third bracket and mutually aligned fourth corners of the first and second screens are inserted into the internal slot of a fourth bracket.

When the graphics object is one-sided, the display side may be placed against either of the at least two screens and the remaining screen then placed against the opposite side of the graphics. If the display side is facing in the wrong direction when the user goes to insert the assembly into one or more internal slots, the assembly may simply be flipped 180 degrees so as to face in the same direction as the front surface of brackets 100.

Once the brackets are in place on the assembled graphics and first and second screens, with a gripping member, the first screen is pressed against the graphics object and second screen and the second screen is pressed against an internal surface of an internal slot of each bracket to selectively lock the first screen, the second screen and the graphics object within each bracket. In an example, the internal surface of internal slot 109 is the closest feature of internal slot 109 to the front surface of a bracket 100.

As mentioned above, the gripping member may be a threaded fastener housed in a bore of each bracket and pressing the first screen against the second screen and the second screen against an internal surface of the internal slot with the gripping member is accomplished by rotating the fastener in a first direction within the bore of the at least one bracket. The action of pressing first and second screens together within an internal slot of a bracket may be repeated for as many brackets as have been provided with the framing system. In an example, a tool may be provided to facilitate rotation of the fastener.

With first and second screens, a graphics object and one or more brackets assembled and gripped with a flush fitment, an anchor point is marked on a support surface such as a wall by pressing a protuberance of one or more brackets into the support surface to produce a small scratch, hole, depression, dent, recess or cavity.

A support fastener may then be driven into the support surface at or near to the position of the mark and one of the brackets of the assembled first and second screens, graphics object and bracket may be coupled with the fastener by placing an enlarged portion of a keyhole opening over the head of the fastener and then moving the fastener head or the bracket or allowing the bracket to move relative to the fastener so that the head of the fastener is encompassed by the slot or constricted portion of the keyhole opening. As such, the bracket is hung on a support fastener.

The action of driving a support fastener into the support surface may be repeated for as many fasteners as the user prefers to support the framing system and framed graphics object. In an example, if the viewing angle of the graphics object is oblique compared with edges of the first and second screens, the user may prefer to drive a single fastener into the support surface and place the keyhole opening over/around the head of the fastener to hang a single bracket. In another example, the user may prefer to drive two fasteners into the support surface at equal heights and place the keyhole opening of each of two brackets over/around the heads of the fasteners to hang the two brackets such that the framing system and framed graphics object hang from the support surface at a horizontal viewing angle. In yet another example, the user may prefer to drive four fasteners into the support surface and place the keyhole opening of each of four brackets over/around the heads of the fasteners to hang the four brackets such that the framing system and framed graphics object hang from the support surface at a horizontal viewing angle with added security.

The above-described actions are only illustrative and other alternatives can also be provided where one or more actions are added, one or more actions are removed, or one or more actions are provided in a different sequence without departing from the scope of the claims herein.

Modifications to embodiments of the disclosure described in the foregoing are possible without departing from the scope of the disclosure as defined by the accompanying claims. Expressions such as "including", "comprising", "incorporating", "consisting of", "have", "is" used to describe and claim the disclosure are intended to be construed in a non-exclusive manner, namely allowing for items, components or elements not explicitly described also to be. Reference to the singular is also to be construed to relate to the plural.

What is claimed is:

1. A graphics display system, comprising:

a first screen with inner and outer surfaces and a plurality of edges between the inner and outer surfaces; and a second screen with inner and outer surfaces and a plurality of edges between the inner and outer surfaces;

a first bracket, including:

a front wall;

a rear wall parallel with the front wall;

a first sidewall orthogonal to the front wall;

a second sidewall orthogonal to the front wall and to the first sidewall;

a third sidewall orthogonal to the front wall and forming an acute angle with each of the first and second sidewalls;

an internal slot extending into the third sidewall towards the first and second sidewalls, the internal slot encompassing at least a first edge of the plurality of edges of the first screen and at least a first edge of the plurality of edges of the second screen such that at least a first edge of the plurality of the edges of the first screen is aligned with at least a first edge of the plurality of edges of the second screen and the inner surface of the first screen is constrained relative to the inner surface of the second screen;

a bore extending into the internal slot through the rear wall or through the front wall;

a keyhole opening extending into the rear wall and configured to receive a head of a fastener and a portion of a shaft of the fastener; and at least one protuberance adjacent to the keyhole opening;

a second bracket, including:

a front wall;

a rear wall parallel with the front wall;

a first sidewall orthogonal to the front wall;

a second sidewall orthogonal to the front wall and to the first sidewall;

a third sidewall orthogonal to the front wall and forming an acute angle with each of the first and second sidewalls;

an internal slot extending into the third sidewall towards the first and second sidewalls, the internal slot encompassing at least a second edge of the plurality of edges of the first screen and at least a second edge of the plurality of edges of the second screen such that one or more other edges of the first screen is aligned with one or more other edges of the second screen; and a bore extending into the internal slot through the rear wall or through the front wall; and a first gripping member extending from the bore of the first bracket into the internal slot of the first bracket and compressing the first and second screens; and a second gripping member extending from the bore of the second bracket into the internal slot of the first bracket and compressing the first and second screens.

2. The system as set forth in claim 1, wherein at least the first screen is configured to enable viewing of one or more objects therethrough.

3. The system as set forth in claim 1, further comprising:

a third bracket including:

a front wall;

a rear wall parallel with the front wall;

a first sidewall orthogonal to the front wall;

a second sidewall orthogonal to the front wall and to the first sidewall;

a third sidewall orthogonal to the front wall and forming an acute angle with each of the first and second sidewalls;

an internal slot extending into the third sidewall towards the first and second sidewalls, the internal slot encompassing at least a third edge of the plurality of edges of the first screen and at least third edge of the plurality of edges of the second screen such that a third edge of the plurality of edges of the first screen is aligned with a third edge of the plurality of edges of the second screen; and a bore extending through the rear wall into the internal slot; and a gripping member extending from the bore of the third bracket into the internal slot of the third bracket and compressing the first and second screens.

4. The system as set forth in claim 3, further comprising:

a fourth bracket including:

a front wall;

a rear wall parallel with the front wall;

a first sidewall orthogonal to the front wall;

a second sidewall orthogonal to the front wall and to the first sidewall;

a third sidewall orthogonal to the front wall and forming an acute angle with each of the first and second sidewalls;

an internal slot extending into the third sidewall towards the first and second sidewalls, the internal slot encompassing at least a fourth edge of the plurality of edges of the first screen and at least fourth edge of the plurality of edges of the second screen such that a fourth edge of the plurality of edges of the first screen is aligned with a fourth edge of the plurality of edges of the second screen; and a bore extending through the rear wall into the internal slot; and a gripping member extending from the bore of the fourth bracket into the internal slot of the fourth bracket and compressing the first and second screens.

5. A framing system, comprising:

a first screen having inner and outer surfaces and a plurality of edges between the inner and outer surfaces;

a second screen having inner and outer surfaces and a plurality of edges between the inner and outer surfaces;

a first bracket including:

a front wall;

a rear wall parallel with the front wall;

a first sidewall orthogonal to the front wall;

a second sidewall orthogonal to the front wall and to the first sidewall;

a third sidewall orthogonal to the front wall and forming an acute angle with each of the first and second sidewalls;

an internal slot extending into the third sidewall towards the first and second sidewalls and configured to receive a portion of the inner and outer surfaces of the first screen as well as a portion of the inner and outer surfaces of the second screen;

a keyhole opening extending into the rear wall and configured to receive a head of a fastener and a portion of a shaft of the fastener; and at least one protuberance adjacent to the keyhole opening of the first bracket; and a first gripping member configured to selectively extend into the internal slot of the first bracket to secure the portion of the inner and outer surfaces of the first screen as well as the portion of the inner and outer surfaces of the second screen.

6. The system as set forth in claim 5, wherein the internal slot is configured to align one or more edges of the first screen with one or more edges of the second screen.

7. The system as set forth in claim 5, wherein at least the first screen is configured to enable viewing of one or more objects therethrough.

8. The system as set forth in claim 5, further comprising:

a second bracket including:

a front wall;

a rear wall parallel with the front wall;

a first sidewall orthogonal to the front wall;

a second sidewall orthogonal to the front wall and to the first sidewall;

a third sidewall orthogonal to the front wall and forming an acute angle with each of the first and second sidewalls; and an internal slot extending into the third sidewall towards the first and second sidewalls; and a second gripping member configured to selectively extend into the internal slot of the second bracket to secure the portion of the inner and outer surfaces of the first screen as well as the portion of the inner and outer surfaces of the second screen.

9. The system as set forth in claim 8, further comprising:

a third bracket including:

a front wall;

a rear wall parallel with the front wall;

a first sidewall orthogonal to the front wall;

a second sidewall orthogonal to the front wall and to the first sidewall;

a third sidewall orthogonal to the front wall and forming an acute angle with each of the first and second sidewalls; and an internal slot extending into the third sidewall towards the first and second sidewalls;

a fourth bracket including:

a front wall;

a rear wall parallel with the front wall;

a first sidewall orthogonal to the front wall;

a second sidewall orthogonal to the front wall and to the first sidewall;

a third sidewall orthogonal to the front wall and forming an acute angle with each of the first and second sidewalls; and an internal slot extending into the third sidewall towards the first and second sidewalls;

a third gripping member configured to selectively extend into the internal slot of the third bracket to secure the portion of the inner and outer surfaces of the first screen as well as the portion of the inner and outer surfaces of the second screen; and a fourth gripping member configured to selectively extend into the internal slot of the fourth bracket to secure the portion of the inner and outer surfaces of the first screen as well as the portion of the inner and outer surfaces of the second screen.

10. A method for framing graphics, comprising:

securing the graphics to a first screen having inner and outer surfaces;

placing, against the graphics, a second screen having inner and outer surfaces such that the graphics is between the first screen and the second screen;

inserting the assembled graphics, first screen and second screen into an internal slot of at least one bracket;

with a gripping member, pressing the first screen against the second screen and the second screen against an internal surface of the internal slot; and marking an anchor point by pressing a protuberance of the at least one bracket into a support surface.

11. The method as set forth in claim 10, wherein pressing the first screen against the second screen and the second screen against the internal surface of the internal slot with the gripping member further comprises rotating a fastener in a first direction within a bore of the at least one bracket.

12. The method as set forth in claim 10, further comprising hanging the at least one bracket on a fastener driven into a support surface by inserting a head of the fastener into a keyhole provided to the first bracket.

13. The method as set forth in claim 10, further comprising inserting the assembled graphics, the first screen and the second screen into an internal slot of a second bracket.

14. The method as set forth in claim 13, further comprising inserting the assembled graphics, the first screen and the second screen into an internal slot of a third bracket.

15. The method as set forth in claim 14, further comprising inserting the assembled graphics, the first screen and the second screen into an internal slot of a fourth bracket.

* * * * *